US006659159B2

(12) United States Patent
Fritsche et al.

(10) Patent No.: US 6,659,159 B2
(45) Date of Patent: Dec. 9, 2003

(54) SCREEN MOUNTING APPARATUS

(75) Inventors: Mark Fritsche, Eagan, MN (US); Dan Berg, Minneapolis, MN (US); Jason Johnson, Minneapolis, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

(21) Appl. No.: 09/953,099

(22) Filed: Sep. 13, 2001

(65) Prior Publication Data

US 2003/0047294 A1 Mar. 13, 2003

(51) Int. Cl.[7] ..... A47G 5/00

(52) U.S. Cl. ..... 160/371; 160/135; 160/351; 40/610

(58) Field of Search ..... 160/135, 351, 160/371, 377, 378, 380, 382, 392, 395, 398, 399, 402; 40/605, 610; 52/646

(56) References Cited

U.S. PATENT DOCUMENTS

| | | | | | |
|---|---|---|---|---|---|
| 3,373,464 | A | * | 3/1968 | Ausnit | 160/399 X |
| 3,824,753 | A | * | 7/1974 | Anderson | 52/203 |
| 3,975,850 | A | | 8/1976 | Giaume | 40/125 |
| 4,028,230 | A | * | 6/1977 | Rosenblum | 209/403 |
| 4,107,826 | A | * | 8/1978 | Tysdal | 160/399 X |
| 4,173,803 | A | * | 11/1979 | Kennedy | 5/13 |
| 4,194,313 | A | | 3/1980 | Downing | 40/610 |
| 4,351,411 | A | * | 9/1982 | Inoue | 181/168 |
| 4,471,548 | A | | 9/1984 | Goudie | 40/610 |
| 4,549,334 | A | * | 10/1985 | Miller | 29/278 |
| 4,658,560 | A | | 4/1987 | Beaulieu | 52/646 |
| 4,799,299 | A | * | 1/1989 | Campbell | 24/462 |
| 4,800,663 | A | | 1/1989 | Zeigler | 40/610 |
| 4,860,814 | A | * | 8/1989 | Vilmann et al. | 160/381 |

(List continued on next page.)

OTHER PUBLICATIONS

Skyline Displays, Inc., *ps2000 brochure*, 2001.
Skyline Displays, Inc., *imagine that. brochure*, 2000.
Skyline Displays, Inc. *design ideas brochure*,2000.
Skyline Displays, Inc., *How Do You Market Your e–Business Offline? brochure*, 2001.
Skyline Displays, Inc., *mirage plus brochure*, 2001.
Syline Displays, Inc., *skytruss brochure*, 2001.
Trussworks, Truss Catalog web page printout, *Truss Parts*, Aug. 17, 2001.
Trussworks, Truss Catalog web page printout, *Trussworks Photos, Graphics Frame*, p. 1, Aug. 17, 2001.
Trussworks, Truss Catalog web page printout, *Trussworks Photos, Graphics Frame*, p. 2, Aug. 17, 2001.
Trussworks, Truss Catalog web page printout, *Trussworks Photos, Exhibit Photos*, p. 1, Aug. 17, 2001.
Trussworks, Truss Catalog web page printout, *Trussworks Photos, Graphics Frame*, p. 12 Aug. 17, 2001.

*Primary Examiner*—Bruce A. Lev
(74) *Attorney, Agent, or Firm*—Patterson,Thuente, Skaar, & Christensen, P.A.

(57) ABSTRACT

A screen mounting apparatus for mounting a graphic display screen for use with display stands or booths, such as those used in trade shows and other exhibitions. The apparatus is designed to receive, generally by adhesive affixation, a display graphics screen such that generally the entire length of one of the screen edges is affixed to the apparatus, with the length of the screen edge and the apparatus generally equaling that of the corresponding display frame segment. Additionally, the screen mounting apparatus includes an elastic portion which permits a limited degree of resilient movement when force is placed upon the screen at assembly and disassembly. The tension force required to mount the apparatus and the affixed screen to a display frame is thus distributed along the entire surface of the apparatus and screen, and not at isolated fastening points.

18 Claims, 4 Drawing Sheets

U.S. PATENT DOCUMENTS 5,042,551 A * 8/1991 Ein et al. ..... 160/90
5,097,761 A * 3/1992 Hamu ..... 101/127.1
5,115,623 A 5/1992 Ahlberg ..... 52/646
5,205,337 A * 4/1993 Bozzo ..... 160/84.1
5,245,774 A * 9/1993 Huber ..... 40/603
5,248,044 A * 9/1993 Szilvasi ..... 209/411
5,501,051 A 3/1996 Harlan ..... 52/646
5,507,109 A * 4/1996 Rinzler ..... 40/603
5,517,779 A * 5/1996 Coleman ..... 40/603
5,537,766 A 7/1996 Nickens et al. ..... 40/605
5,797,223 A * 8/1998 Shoup et al. ..... 52/204.1
6,164,364 A * 12/2000 Morris ..... 160/327
6,209,245 B1 * 4/2001 Wittenberg ..... 40/603
6,276,082 B1 * 8/2001 Richards et al. ..... 40/603
6,505,669 B2 * 1/2003 Lilie et al. ..... 160/371

* cited by examiner

SCREEN MOUNTING APPARATUS

FIELD OF THE INVENTION

The present invention relates to displays, and in particular, to an apparatus for removably mounting a screen to the frame of a display unit.

BACKGROUND OF THE INVENTION

In the construction of exhibit and display stands at trade shows, it is a conventional practice to utilize various truss and frame structures to assist in erecting and configuring the walls that create the backdrop for a particular vendor's defined booth space. Screens are traditionally used to substantially cover a large portion of these framing structures. These screens are made of many materials and often contain various designs and graphics for displaying advertisements and presentation materials. To facilitate flexibility and portability, the screens are usually made of cloth or some other thin flexible material. The screens will generally be rectangular and cover a frame opening that is rectangular in the vertical and linear or arcuate in the horizontal.

In displaying graphics on a display stand, it is desirable to make the graphic as attractive as possible, along the entire surface of the screen. Consequently, any crimping, binding, buckling, wrinkling, or other unattractive deviations is surface flatness are ideally avoided. However, it must be kept in mind that these graphics screens must be easily attachable and removable from the framing. As a result, permanent and rigid screening materials are not feasible since a display stand, like those used in trade shows, must be frequently assembled and disassembled.

Attempts have been made to implement screen mounting means that increase the appearance of the screen while at the same time provide a cost and time efficient design that will properly accommodate the innate portability feature of display stands. However, this pursuit has proved difficult. One of the goals is inevitably sacrificed for another.

The most common solutions typically center around the use of mounting means such as hook and loop fasteners ("Velcro®"), magnetic strips, or some combination thereof. Generally, these mounting means are designed so that the flushness or tightness of the screen can be controlled through the attachment to the display framing. Magnetic or Velcro® strips border the back of the screens (usually the edges) such that they match up with similar strips on the surface of the frame. Often, the mounting means will extend around the entire perimeter of the screen. These strips are viewed as inexpensive. Most importantly, the ability to make fine adjustments along selective and multiple screen surface areas is likely perceived to be the most advantageous characteristic of the magnetic and Velcro® strips. However, it is this adjustability characteristic that proves to be a problem. Fine adjustments are typically required, and are often quite time consuming. An adjustment to one surface problem area will often require multiple adjustments to other areas in order to achieve the desired screen-wide smoothness. In addition, an adjustment in one area will often introduce a problem in another unanticipated area. While disassembly is quick and easy, mounting visually acceptable screen displays can take an unreasonable amount of time, and take a toll on one's patience.

Other common screen mounting means center around various fasteners. Namely, snaps and clips are traditionally used to attach a screen to the frame at the top and bottom of the frame, and occasionally along the sides of the frame. The snaps, clips, or other fasteners are distantly spaced for attaching the screen to the frame. Consequently, the use of such fasteners invariably results in wrinkling or buckling of the screen since the mounting pressure of the fasteners is directed to focal areas along the screen and is not equally distributed along the entire surface of the screen.

There are some unconventional screen mounting means that are utilized as well. U.S. Pat. No. 5,537,766 is directed to an apparatus that utilizes "frictional engagement" to attach a screen covering to the display panels. This apparatus is a gear system that receives an end of the screen. A rotational adjustment of the gear system draws the screen into the gears (tightening the screen surface) or releasably withdraws the screen (loosening the screen surface), depending upon the direction of the rotational adjustment. While use of this type of system in relatively simple, it also has drawbacks. Specifically, the added complexity and mechanical vulnerability of these moving gear parts is problematic.

Another unconventional screen mounting approach is disclosed in U.S. Pat. No. 4,658,560 ('560). '560 utilizes a mounting groove within the screen itself, in addition to magnetic strips. The groove is essentially a hook on the attaching end of the screen such that the screen will hang over a mounting rod on the display framing. With such a design, the weight of the screen is distributed equally along the entire length of the screen surface. The weight and elasticity of the screen itself is relied upon to prevent unwanted surface buckling and wrinkling. However, since the groove or hook is incorporated within the screen material, the benefits are limited to elastic material of appreciable weight. For instance, if the screen is made of an inelastic cloth or polymer, it will still be necessary to use other mounting means such as magnets or Velcro® to tightly secure the sides and opposite end of the screen to the frame in order to achieve the desired level of distributed tension across the entire length of the screen. With such inelastic screens, it will also be difficult or impossible to mount a screen that relies upon these mounting grooves at each end of the screen. So while this groove mounting technique is beneficial with respect to reducing screen wrinkling, the benefits are only realized with elastic screens, and therefore, greatly limiting its usefulness.

As a result of these deficient screen mounting techniques and practices, there is a need for a cost efficient apparatus for mounting a screen to a display unit such that a favorable level of tension is distributed along the full length of the screen to significantly minimize any screen wrinkling or buckling. This apparatus must be adaptable to multiple screen configurations. Namely, the apparatus must work just as effectively with inelastic screens as it does with elastic screens. In addition, all of these goals must be achieved while at the same time facilitating quick and easy assembly and disassembly of the screen and the portable display structure.

SUMMARY OF THE INVENTION

A screen mounting apparatus for mounting a graphic display screen for use with display stands or booths, such as those used in trade shows and other exhibitions. The apparatus is designed to receive a display graphics screen such that generally the entire length of one of the screen edges is affixed to the apparatus, with the length of the screen edge and the apparatus generally equaling that of the corresponding display frame segment. Additionally, the screen mounting apparatus includes an elastic portion which permits a limited degree of resilient movement when force is placed upon the screen at assembly and disassembly. The tension force required to mount the apparatus and the affixed screen to a display frame is thus distributed along the entire surface of the apparatus and screen, and not at isolated fastening points.

A significant feature and advantage of the present invention is that assembly and disassembly of the apparatus and the affixed screen can be as simple as lifting the apparatus away from the display frame segment for which it is attached. Attachment of the apparatus to the framing segment can be accomplished with a plurality of simple clips.

Another significant feature and advantage is embodied within the elasticity feature of the apparatus. The elasticity permits easy mounting and dismounting of the apparatus. In addition, this feature permits the use of an apparatus at more than one screen edge. Mounting an edge of the screen to a frame segment once a first edge has been mounted is made easy by the permittable movement the elastic apparatus provides. In addition, this elasticity characteristic ensures that constant tension will be maintained along the entire surface of the screen, therefore limiting screen wrinkling and buckling and maximizing visual appeal.

Yet another significant feature and advantage of the present invention centers around the surface distributed affixation technique. Since substantially all of a screen edge is affixed to a similar length of the apparatus, screen tension force is equally distributed along the surface of the screen and the length of the apparatus to assist in minimizing surface wrinkling and buckling.

A further feature and advantage of the present invention is that the elastic benefits can be utilized even on those screens with no elastic characteristics within the screen material since the elastic techniques are encompassed within the apparatus and not the screen.

A still further feature and advantage of the present invention is found in the manufacturing costs. The screen mounting apparatus can be made from extruding relatively inexpensive polymer materials.

The hook-shape member may be configured as individual hooks as best illustrated in FIG. 3 or may extend the width of the screen mounting apparatus as illustrated in FIG. 7. The use of the extrusion of differing materials provides a high performance, generally simple and inexpensive to manufacture, screen mounting apparatus that may be easily attached and detached without requiring tools or significant manual dexterity.

The following U.S. Patent Applications are being filed by the same applicant on the same day as this application and are hereby incorporated by reference: U.S. patent application Ser. No. 09/953,098, entitled "DISPLAY WITH APPURTENANCE ATTACHMENT"; U.S. patent application Ser. No. 09/953,111, entitled "BOX FRAME ASSEMBLY"; U.S. patent application Ser. No. 09/953,113, entitled "MODULAR MULTI-CONFIGURABLE DISPLAY SYSTEM".

DETAILED DESCRIPTION OF THE PREFERRED EMBODIMENTS

Figure 2:
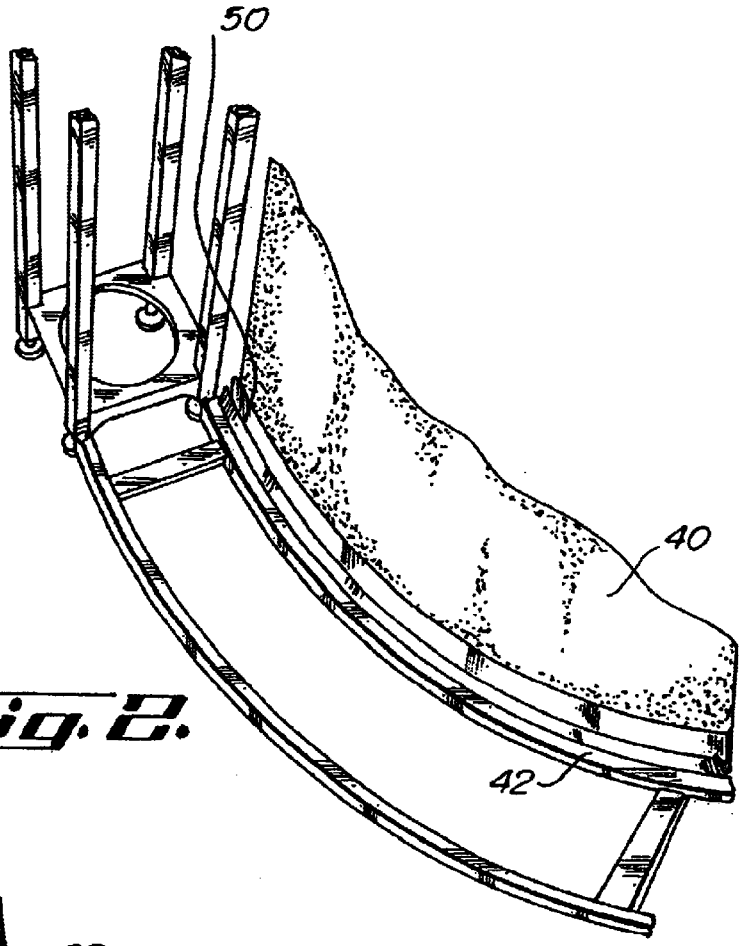
FIG. 2 is a detailed perspective view of a portion of the display of FIG. 1 illustrating aspects of the invention.
Figure 1:
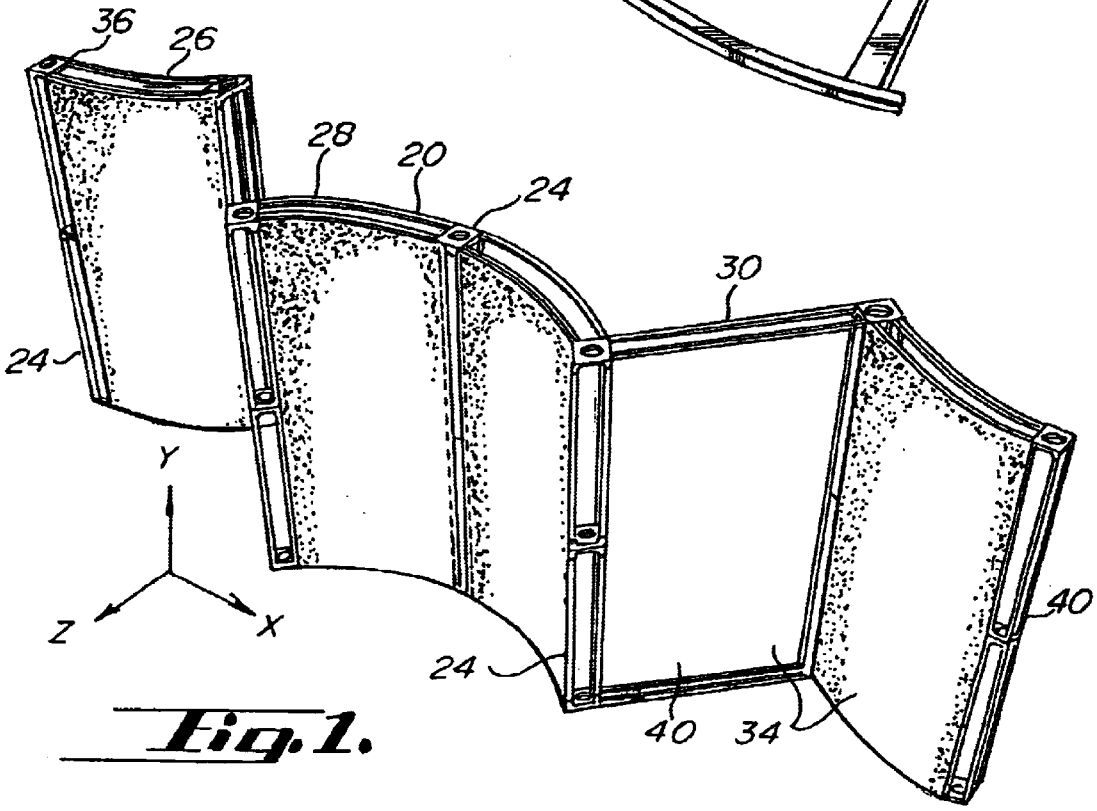
FIG. 1 is a perspective view of a potion of the display structure embodying the invention herein.

Referring to FIGS. 1 and 2, a portable disassemblable display structure 20 is shown which is intended for use at trade shows and specifically highly suitable for use as a back wall at trade show exhibits. The display structure comprises a plurality of open vertical columns 24, a plurality of horizontal spanning members 26 including arcuate horizontal spanning members 28 and linear horizontal spanning members 30. The vertical columns 24 and horizontal spanning members 28 define rectangular frame openings 34, including arcuate rectangular frame openings 36 which utilize the arcuate horizontal spanning members 28. Thus, these arcuate rectangular frame openings 34 are linear in the vertical or XY YZ planes and curved, specifically arcuate in the XZ plane.

The horizontal frame members 28 and vertical columns 24 are easily connected by way of connectors not illustrated but described fully in the related U.S. patent application Ser. No. 09/953,117, filed on the same date as this application and entitled, "MODULAR DISPLAY SYSTEMS."

Figure 3:
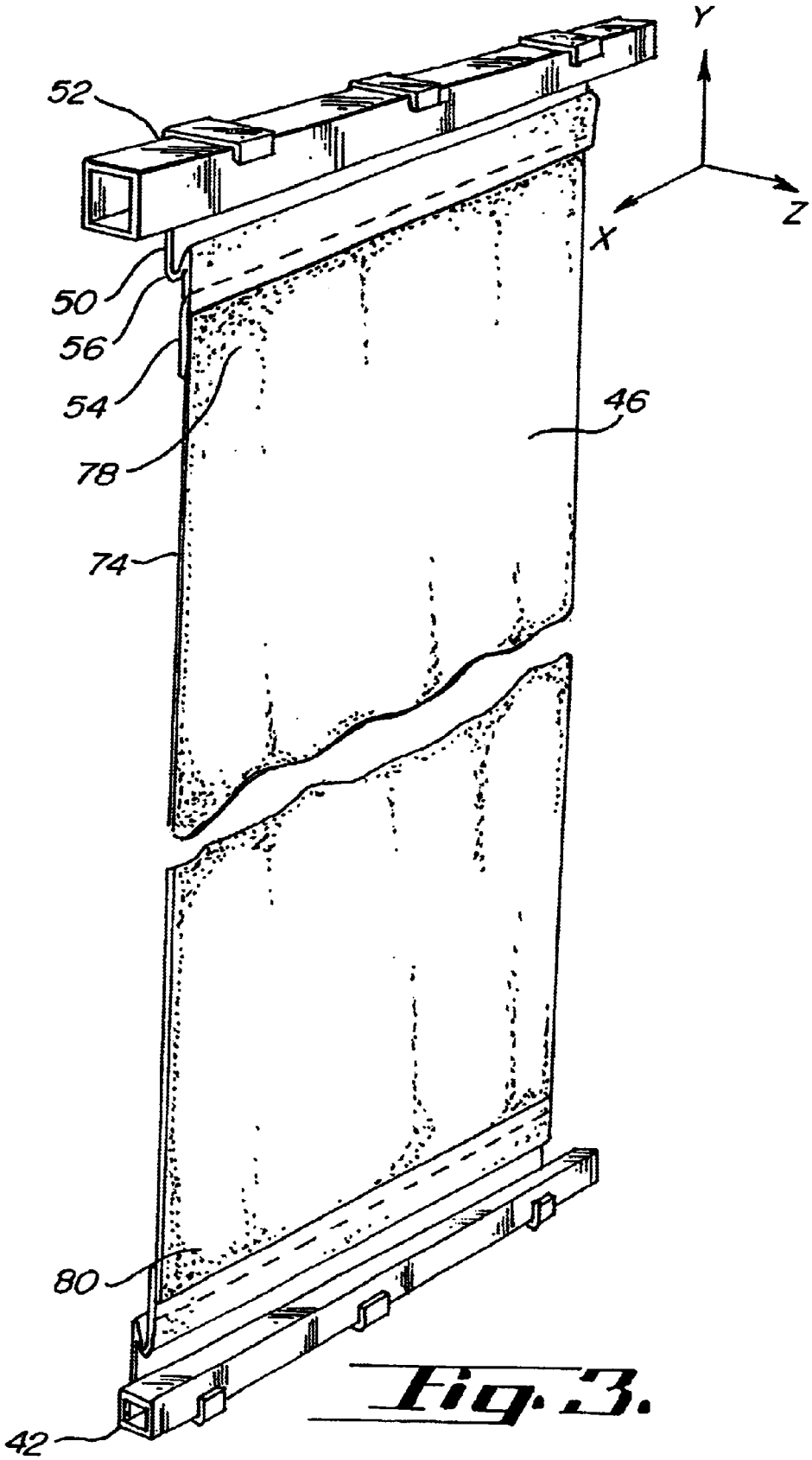
FIG. 3 is a perspective view of a screen in accordance with the invention herein attached to a pair of horizontal support members.

Referring more particularly to FIGS. 2 and 3, traversing the plurality of frame openings are a plurality of screens 40 generally formed of flexible material. The screens 40 are primarily rectangular in shape and are formed of material such as textile material, vinyl, or other known sheet materials of flexible and inflexible make-up. The sheet screens 40 are removably mounted to horizontal support members 42. The screens 40 comprise the rectangular sheet material 46 and a mounting apparatus 50.

Referring to FIGS. 3, 4, 5, and 6, details of the mounting apparatus 50 are illustrated. The mounting apparatus is principally comprised of a frame attachment 51 or clasping portion 52, a screen material attachment portion 54, and a bias providing elastic portion 56.

The screen mounting apparatus 50 is preferably formed from a piece 60 of extruded thermal plastic material. In a preferred embodiment, the extrusion will be formed of at least two different materials having different characteristics. Polyvinyl chloride (PVC) has been found to be a very suitable material for specific portions of the extruded piece 60. For example, the portion 64 of the extruded piece 60 that is part of the attachment portion 51 of the apparatus as well as the screen material attachment portion 54 could be made of PVC. Also, in certain embodiments in which the elastic portion 56 is formed of a spring section 66 having at least a C-shape in the cross-section or further folds to comprise an S-shape or perhaps more folds. Additionally, a second material generally of a lower durometer and having greater flexibility may be utilized in embodiments of the screen mounting apparatus 50 in which the elastic portion 56 does not rely exclusively or principally upon folds in the extrusion. See, for example, FIG. 7 and FIG. 5. Additionally, this second plastic portion may be generally narrower than the rest of the extrusion, adding further elastic characteristics and also providing advantageously a living hinge 70 which facilitates the folding and rolling up of the screen when not in use. The screen material attachment portion 54 generally extends the width of the rectangular screen material piece as well as the width of the screen mounting apparatus. Although, in certain instances it may be desirable to have the screen attachment portion 54 extending beyond the lateral edges 74 of the screen material piece for aesthetic or other reasons. The screen material portion may be of fabric, vinyl material, or other flexible, foldable thin sheet material. In addition, non-flexible sheet materials can be used, depending on the elastic characteristics of the elastic portion 56. Upper and lower horizontal extending strips 78, 80 are secured to the screen material attachment portion 54 by way of adhesive or other suitable attachment means.

Figures 4, 5, 6:
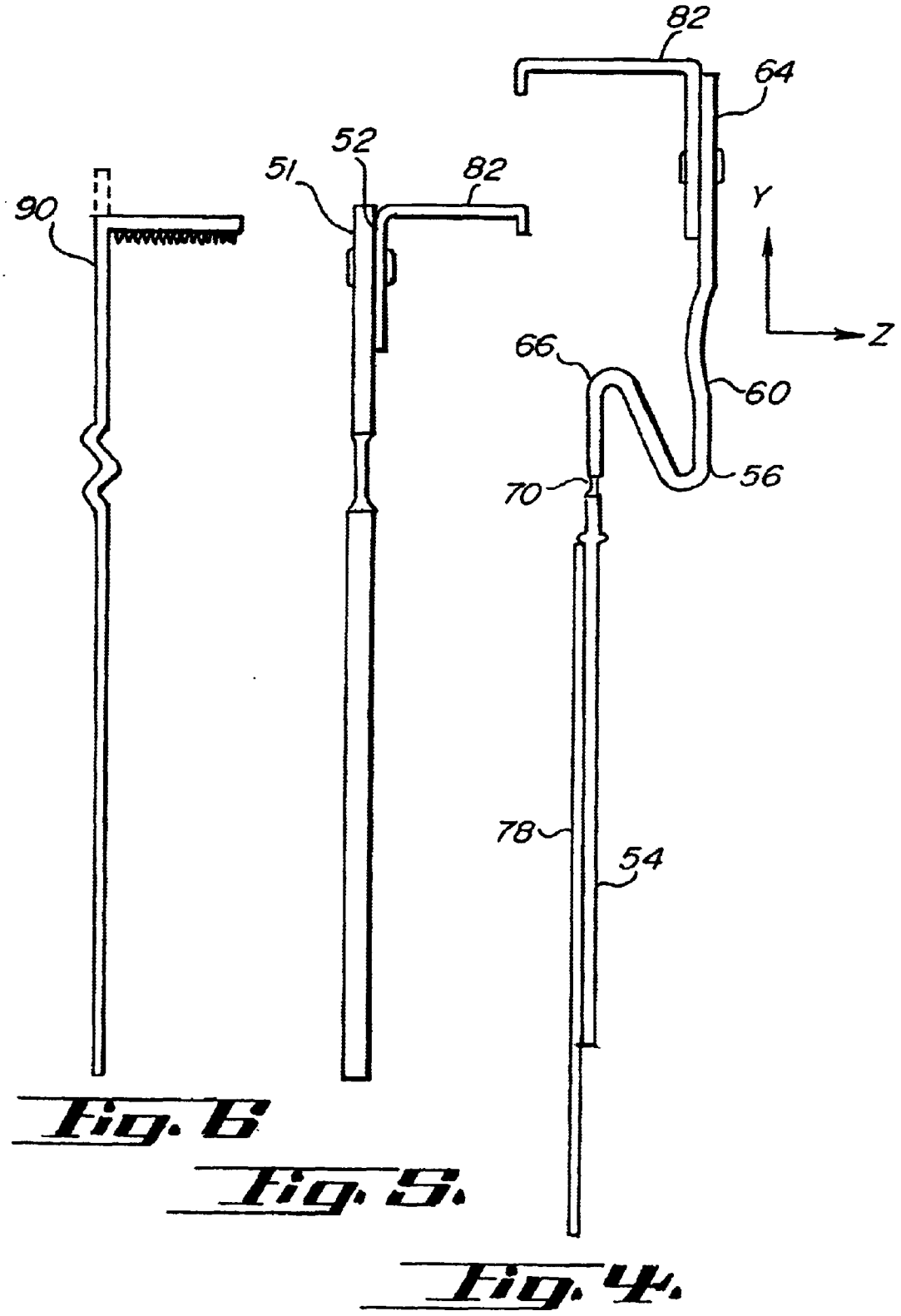
FIG. 4 is a side elevational view of a screen mounting apparatus in accordance with the invention herein.
FIG. 5 is a further embodiment of a screen mounting apparatus in accordance with the invention herein.
FIG. 6 is a further embodiment of a screen mounting apparatus in accordance with the invention herein.
Figure 6A:
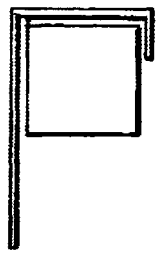
FIGS. 6A–6I are schematic views of alternative embodiments of the attachment portion in accordance with the invention herein.
Figure 6B:
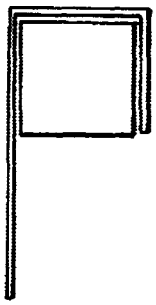
Figure 6C:
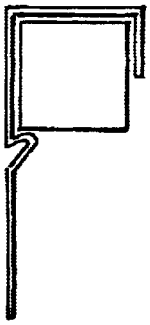
Figure 6D:
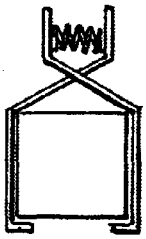
Figure 6E:
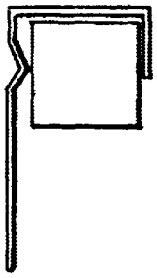
Figure 6F:
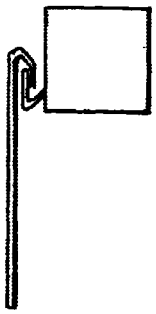
Figure 6G:
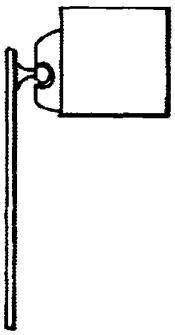
Figure 6H:
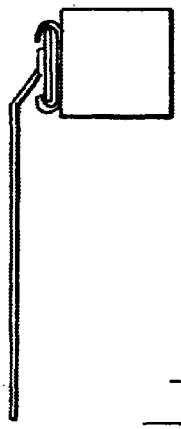
Figure 6I:
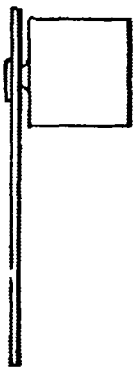

Continuing to refer to FIGS. 3, 4, 5, 6, and 7, the frame attachment 51 portion may be configured as a clasping portion 52 having hook-shape members 82 as illustrated in FIGS. 4, 5, and 7. Such hook materials may be formed of appropriately shaped sheet metal such as steel. The hook-shape would be suitably sized for the support member. Such hook members may be attached to the extruded piece 60 by way of rivets or other suitable fastening means. Such hook member may include a strip of magnetic material 88 to secure the attachment of the mounting apparatus to the support member 42. Other configurations could utilize an L-shape member 90 as part of the extrusion as illustrated in FIG. 6 with a piece of hook and loop material such as Velcro® extending along the width or along portions of the width of the extrusion. In addition, alternative configurations for the attachment portion 51 are shown in the schematic FIGS. of 6A–6I.

The hook-shape member may be configured as individual hooks as best illustrated in FIG. 3 or may extend the width of the screen mounting apparatus as illustrated in FIG. 7. The use of the extrusion of differing materials provides a high performance, generally simple and inexpensive to manufacture, screen mounting apparatus that may be easily attached and detached without requiring tools or significant manual dexterity. The screen apparatus is utilized typically after the framework of the display structure has been assembled and appropriately positioned. The screen comprising the screen material and screen mounting apparatus will generally be folded or rolled up around one of the screen mounting apparatus, facilitated by the living hinge. In addition, it will be unrolled and the top and bottom screen mounting apparatuses will be attached to the respective upper and lower horizontal support members of the framework defining the rectangular frame opening.

Notably, the use of an extended extrusion that spans the width of the screen material provides several inherent advantages. Designating that the extrusion generally has a length in the Z direction of the XYZ, the height of the extrusion is in the Y direction. Relative to the overall extrusion will be flexibility in the XZ plane to facilitate fastening to arcuate horizontal spanning members 28, as illustrated in FIGS. 1 and 2. Moreover, the overall extrusion will be relatively stiff and rigid in the XY plane except for the elastic portion provided in the Y direction. Utilizing the elastic portion extending the entire width of the screen mounting apparatus provides a uniform bias across the width of the screen material portion as well as preventing slack in the width or X direction.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In a portable, disassemblable display structure for displaying graphic material, the display structure including a display frame having a pair of horizontal support members vertically spaced from one another, and a screen constructed of sheet material, the screen having a width substantially equal to the horizontal span of the horizontal support members and a height substantially equal to the vertical spacing of the horizontal support members, the improvement comprising a screen mounting apparatus for use in mounting the screen to the display frame, the apparatus including:

a frame clasping attachment portion removably securable to the display frame;

a screen material attachment portion adapted to fixedly receive an end portion of the screen such that substantially the entire length of the end portion of the screen is fixedly received; and an elastic portion joining the frame clasping portion and the screen attachment portion such that appropriate force upon the screen attachment portion results in an appropriate resilient displacement of the apparatus.

2. The apparatus of claim 1, wherein the elastic portion extends substantially the width of the screen attachment portion.

3. The apparatus of claim 1, wherein the elastic portion is integral with the screen attachment portion.

4. The apparatus of claim 1, wherein the frame clasping portion and the screen attachment portion are formed from dual durometer plastic.

5. The apparatus of claim 1, wherein a clip is attached to the frame clasping portion for removably securing the screen mounting apparatus to the display frame.

6. The apparatus of claim 1, wherein the elastic portion is generally C-shaped.

7. The apparatus of claim 1, wherein the elastic portion is generally S-shaped.

8. The apparatus of claim 1, wherein the elastic portion includes a hinge portion.

9. In a portable, disassemblable display structure for displaying graphic material, the display structure including a display frame and a screen, the improvement comprising a screen mounting apparatus for use in mounting the screen to the display frame including:

frame clasping means removably securable to the display frame;

screen attachment means adapted to fixedly receive an end portion of the screen such that substantially the entire length of the end portion of the screen is fixedly received; and means for resiliently joining the frame clasping means and the screen attachment means.

10. The apparatus of claim 9, wherein said means for resiliently joining the frame clasping means and the screen attachment means includes a hinge.

11. The apparatus of claim 9, wherein said means for resiliently joining the frame clasping means and the screen attachment means comprises a spring member.

12. The apparatus of claim 11, wherein said spring member comprises folded plastic material.

13. The apparatus of claim 11, wherein said spring member is formed from elastic material.

14. A portable, manually disassemblable display structure comprising:

a framework, including at least a pair of spaced apart columns and a pair of spaced apart horizontal members connecting the columns, the columns and the horizontal members together forming at least one display frame;

a screen having a pair of opposing margins, each margin having a length; and a pair of screen mounting devices for mounting the screen on the display frame, each of the screen mounting devices including:

a screen attachment portion secured to substantially all of the length of a separate one of the pair of opposing margins of the screen;

a frame attachment portion removably securable to the display frame; and an elastic portion resiliently coupling the frame clasping portion and the screen attachment portion.

15. The display structure of claim 14, wherein the elastic portion comprises folded plastic material.

16. The display structure of claim 14, wherein the elastic portion is integral with the screen attachment portion and the frame attachment portion.

17. The display structure of claim 14, wherein the elastic portion comprises elastic material.

18. The display structure of claim 14, wherein the elastic portion is adapted to hingably couple the screen attachment portion and the frame attachment portion.

* * * * *